United States Patent [19]

Maurer et al.

[11] Patent Number: 4,465,378

[45] Date of Patent: Aug. 14, 1984

[54] CLOCK MOVEMENT

[75] Inventors: Roland Maurer; Robert Wolber, both of Lauterbach-Sulzbach; Walter Obergfell; Hans Flaig, both of Schramberg, all of Fed. Rep. of Germany

[73] Assignee: Gebruder Junghans GmbH, Schramberg, Fed. Rep. of Germany

[21] Appl. No.: 448,054

[22] Filed: Dec. 9, 1982

[30] Foreign Application Priority Data

Dec. 17, 1981 [DE] Fed. Rep. of Germany ... 8136793[U]

[51] Int. Cl.³ ..... G04C 23/02

[52] U.S. Cl. ..... 368/88; 368/80

[58] Field of Search ..... 368/76, 80, 88, 220, 368/223, 276, 299, 300, 316–318

[56] References Cited

U.S. PATENT DOCUMENTS

| | | | |
|---|---|---|---|
| 3,943,695 | 3/1976 | Bauer et al. . | |
| 3,945,192 | 3/1976 | Wolber . | |
| 3,998,044 | 12/1976 | Yamauchi et al. | 368/80 |
| 4,086,753 | 5/1978 | Tsuchiya et al. | 310/40 MM |
| 4,175,374 | 11/1979 | Yoshizawa . | |
| 4,263,667 | 4/1981 | Wolber et al. . | |
| 4,274,153 | 6/1981 | Fume et al. | 368/80 |
| 4,316,277 | 2/1982 | Endo | 368/76 |
| 4,392,748 | 7/1983 | Yoshino | 368/88 |

*Primary Examiner*—Vit W. Miska

*Attorney, Agent, or Firm*—Burns, Doane, Swecker & Mathis

[57] ABSTRACT

A clock movement comprises front and rear housing shells. A support plate is mounted within and between the shells. A gear movement is mounted on a rear side of the support plate and faces the rear shell. A hands movement is arranged on a front side of the support plate and is drivingly connected to the gear movement. A circuit board is connected to the support plate. A motor for the gear movement comprises a stator sheet and a coil bobbin. The stator sheet is fastened in engaging relationship to a rear side of the support plate adjacent a rotor opening in the stator sheet. The coil bobbin is mounted on the stator sheet and includes a plurality of pins which define coil terminals. The pins are soldered to a circuit of the circuit board. The circuit board is disposed in front of the support plate in spaced relationship therewith and is of arc-like configuration such that legs of the arc straddle the minute and hour wheels of the hands movement.

13 Claims, 5 Drawing Figures

CLOCK MOVEMENT

RELATED APPLICATIONS

Attention is directed to the following copending patent applications in relation to the structure of the stator disclosed herein: U.S. application Ser. No. 448,055, filed 12/9/82, by Gerd Kramer entitled CLOCKWORK STEPPING MOTOR, and U.S. application Ser. No. 450,274, filed by Walter Obergfell et al entitled A CLOCKWORK STEPPING MOTOR STATOR AND PROCESS FOR MAKING SAME.

BACKGROUND AND OBJECTS OF THE INVENTION

The invention concerns a clock movement and, in particular, a clock movement having a circuit board held by a supporting plate within a split-shell housing; a hands movement is arranged in front of the supporting plate, while a gear movement is disposed behind the supporting plate and mounted thereon.

A clock movement of this type is known from U.S. Pat. No. 3,945,192. This movement has proven successful especially in terms of its manufacturing advantages over prior movements wherein the movement is located between two plates spaced apart by means of posts. In the U.S. patent the works are to be mounted on both sides of a single sheet support plate. A disadvantage, however, involves the great structural depth in the direction of the hands and gear shafts, as well as the use of the circuit board for both carrying the electric drive actuating circuit, and as a functional structural part for bearing gear support; this type of usage involves special requirements in relation to the fabrication material and the manner of installation of the circuit board.

It is known from U.S. Pat. No. 4,263,667 to use in a clock movement of this generic type a step motor as an electromechanical transducer. The stator is mounted, as are the other structural elements of the timekeeping, quartz stabilized drive circuit, on the circuit board, in particular by means of connecting pins passing through the circuit board. The stator is soldered to those pins on the side of the board laminated to form conductor bars. The step motor rotor is disposed in the rotor opening between the stator sheet pole shoes and is equipped with a flying bearing support on a pin which is anchored parallel to the front shell of the two-shell housing of the clock movement. The gear and hands movement is mounted on an intermediate plate positioned on posts in the front shell of the housing and is bearingly supported between the front wall of the front housing shell and the rear wall of the rear housing shell. This movement has proven itself in millions of cases. A disadvantage relates to the relatively great depth of installation required in particular by the circuit board extending parallel to the work axis, and the need for high manufacturing accuracy as a consequence of the distribution of the bearing locations of the movement over different structural parts to be joined frictionally to each other, which may have a detrimental effect on the efficiency of the step motor and the configuration of the gears, and on the generation of noise.

A basically similar clock movement is known from U.S. Pat. No. 3,943,695, in which the gear and hands movement is mounted in a conventional manner between two plates spaced apart by posts, with one of the plates being equipped with studs for the positioning of a rivetted step motor stator. The circuit board for the electronic drive circuit is fastened parallel to the step motor stator in a spaced apart manner on extensions of the plate posts. To connect the coil with the circuit board, this distance is bridged by a coil terminal pin, anchored in the coil bobbin carried by the stator sheet. The step motor rotor is supported on the bottom of a pot-like recess in the plate to which the step motor stator is rivetted, with a separate bridge being provided as the second bearing for the rotor shaft. The second bearing is fastened between the circuit board and the plate. This movement again has the disadvantage of a substantial depth of installation parallel to the works axis and the afore-mentioned disadvantages of the mounting of the drive gears between several plates.

In U.S. Pat. No. 4,175,374 there is provided a bearing support in an intermediate plate and in the rear housing shell. The step motor stator is positioned both on the intermediate plate and on the rear shell of the housing. The circuit board is inserted parallel to the gear axles. These features lead to an undesirably great structural depth in the direction of the works axis, together with a significant effort in relation to assembly technology.

In view of these disadvantages it is the object of the invention to develop a clock movement of the aforementioned basic type, while retaining the manufacturing and functional advantages resulting from the single plate concept, so that an especially flat and easily assembled configuration of a gear and hands movement is provided. The arrangement should be capable of being readily inspected in case of a malfunction and easily repaired, and driven by a step motor with high functional safety and low noise generation.

SUMMARY OF THE INVENTION

The object is attained according to the invention which relates to a clock movement. The clock movement comprises front and rear housing shells. A support plate is mounted within and between the shells. A gear movement is mounted on a rear side of the support plate facing the rear shell. A hands movement includes a minute wheel and an hour wheel. The hands movement is arranged on a front side of the support plate and is drivingly connected to the gear movement. A circuit board is connected to the support plate and comprises an electronic drive actuating circuit. A motor comprises a stator sheet and a coil bobbin. The stator sheet has an opening for a rotor and is fastened in engaging relationship to a rear side of the support plate adjacent the rotor opening. The coil bobbin is mounted on the stator sheet and includes a plurality of pins. The pins define coil terminals and are soldered to a circuit of the circuit board. A rotor is disposed in the rotor opening and is drivingly connected to the gear movement. The circuit board is disposed in front of the support plate in spaced relationship therewith and is of arc-like configuration, whereby the legs of the arc straddle the minute and hour wheels.

The mounting and configuration of the circuit board is thus effected approximately in the plane of the practically flat support plate, i.e., directly on it, and straddles (by means of a U-shape) the location of the minute and hour gear of the hands movement, plus a pot-like depressed rotor bearing. Thus, structural elements can be arranged on the circuit board in or above the plane of the support plate within the space in the rear housing shell. That space is already provided for the gear of the step motor rotor through the seconds gear to the third wheel. The electronic structural elements with a lower installation height may be arranged under gears having large diameters; this makes available the higher installation space within the rear housing shell for higher structural elements, without the need for an overall increase in the structural height of the movement. The circuit board does not have to perform bearing functions and thus may be optimized selectively with respect to its electromechanical requirements. Thus, the coil terminal pins of the stop motor stator (which is placed flat on the support plate) also serve to fasten the circuit board to the support plate, the former being positioned on that side of the support plate facing away from the stator. This fastening occurs during the soldering of the structural elements arranged on the circuit board.

The provision exclusively of flying bearings for the gears on the top side (facing away from the circuit board and facing the rear wall of the housing) of the support plate favors the functional inspection of structural sets. That is, an operationally ready drive assembly consisting of the circuit board with the electronic circuit and the support plate with the step motor and gears may be tested in the completely preassembled condition and then inserted, after this quality control inspection, as a unit into the housing in an operationally non-critical manner. The housing performs no function in relation to the functionally critical parts of the movement. On the other hand, it is possible and preferable in view of the automated assembly operation to install the gears following the insertion of the drive assembly consisting of the support plate and the circuit board with the drive actuation circuit.

It is advisable to develop, in a known manner in the case of this drive assembly, on the side of the support plate facing away from the gears, a flexurally rigid bearing support for the bushings of the hands. This support is in the form of an extended hollow cylinder with an expanding internal diameter, which is molded integrally under the support plate. The smallest internal diameter of the hollow cylinder is capable of serving as an axially short bearing exposed to a slight frictional moment for the seconds hand shaft and thus for the second wheel located on the gear side of the support plate. Since the minute bushing and the hour bushing are rotating relatively slowly, these longitudinally long cylindrical surfaces can rest on each other or on the jacketing of the bearing projection for the hands movement under the support plate.

It is, in principle, possible to bearingly support the third wheel of the hands movement, i.e., the change gear wheel, under the support plate in a manner known in itself. However, in the interest of cost effective manufacturing (i.e., using automatic inserting machines and similar auxiliary assembly units), the change gear wheel is located on a pin molded into the front shell of the housing parallel to the works axis. This is the only part of the drive gear placed by itself in the housing of the movement. This is not critical from an operational standpoint, as a coarse involute gearing is possible in any case from the minute wheel drive through the change gear wheel and its drive to the hour wheel as the slowest wheel of the clock movement. The involute gearing is insensitive to possible variations in the depth of tooth engagement (resulting from strain between the housing shells and the support plate caused by external stresses). On the other hand, this bearing support has the advantage that in the assembly of the movement it is merely necessary, with the front housing shell open, to insert the hour bushing in the passage orifice in the front shell and on the aforementioned pin in the front wall of the change wheel; and then insert in the hour bushing the minute bushing, wherein the bushings inserted into each other are centered by the engagement of the hollow cylindrical projection of the support plate (for the second hand shaft to be placed in it). Following the insertion of the gears, it is only necessary to close the movement housing by the attachment of the rear housing shell in the assembly apparatus, wherein the fastening of the drive assembly against the battery chamber provided in the front housing shell is effected while contacting the circuit board with the battery contact springs.

For this securing of the support plate in the movement housing, i.e., easily accessible for inspection, supporting shoulders or contact projections are provided on the lateral walls of the housing shells approximately in the plane of the partition gap between the housing shells. Between these shoulders the adjacent peripheral area of the support plate is clamped when the two housing shells are screwed together from the rear of the rear housing shell by means of anchoring bolts in the aforementioned insertion apparatus. The screw fastening of the two housing shells to each other has the advantage of providing substantially closer defined assembly conditions when a torque screw driver is used, and thus better defined installation conditions for the drive aggregate, than is customary for the assembly of housings from housing shells by means of snap-in connections. The latter are often damaged in the course of inspection of a malfunction and thereby come unusable, since it cannot be determined from the outside, at least not without further manipulation, which of the snap-in connectors is to be actuated to open the housing. Furthermore, persons skilled in the art, such as watchmakers and jewelers, will hold such a movement in higher esteem, as it is not necessary for such a person to fumble around for an extended period of time in front of customers, as such a movement cannot be opened with his customary tools rapidly and expertly without damage to the housing.

For the afore-mentioned establishment of an electrically conducting connection between the battery poles in the battery chamber to the conductor bars on the laminated side of the circuit board, it is known, from the afore-cited U.S. Pat. Nos. 4,175,374 and 3,911,663, to use single piece battery contact bridges with molded contact areas against the circuit board lamination and integral battery contact springs projecting into the pole end of the battery chamber. This produces, however, a disadvantage in that the bending stress of the contact bridge leads to the rubbing of the contact area against the lamination of the circuit board, thereby damaging it. Also, the contact pressure of the contact area against the lamination of the circuit board, thereby damaging it. Also, the contact pressure of the contact area against the lamination of the circuit board is reduced, resulting in malfunctions because of the increasing uncertainty of contacts. It is therefore convenient, according to a further feature of the invention and in combination with a circuit board held in front of the support plate and with the lamination facing downward to provide a supporting projection in the vicinity of the support shoulders in the front housing shell for each contact bridge. The elastic contact area is supported on that projection when the circuit board lamination is pressed into the front housing shell by means of the clamping of the support plate during the screwing together of the housing shells. The resulting elastic deformation of the otherwise stationary contact area assures high quality electrical contacts. In particular, contact failures due to the stressing of the contact bridge in bending during battery replacements, are prevented.

While the positioning and mounting of the drive assembly is effected during the screwing together of the two housing shells, it is convenient to also include the step motor, i.e., the end of its stator sheet facing away from the rotor opening, between projections provided on the housing shells. This assures that the stator must be positioned in a dimensionally accurate manner in the area of the rotor opening and thus in the area of the drive connection of the gears only. Also, a possible warping of the stator position as the result of the counter-torque to be absorbed by the stator (in view of the long lever arm of the stator sheet extension away from the rotor opening), may be safely prevented.

Furthermore, the stretched-out geometry of the step motor stator makes it possible to employ a high efficiency, material-saving step motor, as it is sufficient to use a single layer stator sheet, the U-legs of which are connected with each other by means of narrow pole shoe bridges. The legs are rapidly saturated during magnetization and act as air gaps, in order to ensure (as is known for clock step motors) optimum rotor opening geometries at all times without any need for adjustments. The long U-legs of the stator sheet make possible the use of two (or preferably only one) axially elongated coil layers within the winding. Since the outer coil windings now contribute to a higher degree to the magnetization of the stator sheet than in the case of axially shorter coils with heavier winding layers, this elongated step motor stator yields a particularly favorable efficiency with an extraordinarily low structural height in the direction of the rotor axis, i.e., transversely to the longitudinal extent of the stator sheet or the partition joint of the housing.

The magnetic back-circuit through the free ends of the U-legs of the stator sheet is established conveniently through a yoke sheet welded onto them, whereby a slight magnetic resistance in the stator sheet magnetic circuit and a high configurational stability of the stator sheet are assured in spite of the very thin pole shoe bridges sensitive to mechanical deformation.

In the step motor there is employed, according to a further feature of the invention, a rotor which in the case of a single layer stator sheet is supported in a hollow cylindrical mounting, injection molded onto the hub of the step motor rotor pinion. This assembly step may be automated, but is less susceptible to failure than the direction injection molding of the rotor pinion, together with the hub, in a fracture-prone rotor hollow cylinder.

In view of the practical requirements, it is desirable to be able to deactivate the drive of the gear movement. It is then possible to set the hour and minute hands manually (by means of the direct manipulation of the hands in front of the face of the watch or in the rear of the movement with an adjusting shaft) to a certain point in time and to reactuate the hands drive when the desired point in time is reached. The present invention deviates from the heretofore customary configuration of an electromechanical breaker contact in the actuation train of the step motor in the drive actuation circuit, since the development of such a switch usually requires two additional terminal pins in the electronic watch circuit and correspondingly large dimensions of the circuit layout. Furthermore, in such a switch the ohmic contact path to be established on the circuit board is prone to failure and is expensive in view of the installation of the circuit board in the movement housing with consideration of the requirement of the support and accessibility of the switch adjusting means. Instead, a locking holder is now provided on the support plate, serving simultaneously as a locating lock and support for a lock bolt, which (while manually accessible through the rear wall of the housing by means of a handle) in one locking position positively engages the teeth of a wheel of the gears, preferably the second wheel. Thus, in spite of the continued actuation of the step motor by the drive actuating circuit, the hands movement is not moving. It is operationally not critical that the electric deactivation of the step motor is no longer possible, since during the storage of large clock movements of this generic type (in contrast to the usual practice in the case of small watch movements) no drive battery is inserted. The power consumption in the case of a blocked hands movement is approximately equal to the consumption during normal operations and therefore there is no detrimental effect on the effective life of the battery.

Since the drive assembly comprises a support plate (described in essence hereinabove) and a flat circuit board, connected with the support plate (and possibly slightly offset in relation to the plane of the support plate), it is possible according to a further feature of the invention, to combine the function of the circuit board (as the carrier of structural elements and as an electric connector between the terminals of said elements) with the function of the support plate in a single piece. For this purpose, in a manner known in itself, a metal conducting frame gridiron serving both for the connection of electric structural elements and mechanical stiffening, may be molded during the injection molding of the support plate, or a support plate expanded by the functional area of the circuit board may be used. This is then equipped with suitably placed printed conductor strips. In both cases, the preparation and installation of a separate circuit board is completely eliminated. During the molding of a conducting frame area combined with the bearing area of the support plate or in the shaping of the printed support plate, bays and the like may be effected, together with recesses for electromechanical connections, which also facilitate the positioning of the structural parts to be joined thereto by welding with their electric terminals, while further reducing the height of the clock movement.

THE DRAWINGS

Further characteristics and advantages of the invention will become apparent from the description hereinafter of two preferred examples of the embodiment of the invention shown to scale but enlarged in the drawing, such that:

DETAILED DESCRIPTION OF A PREFERRED EMBODIMENT OF THE INVENTION

Figure 1:
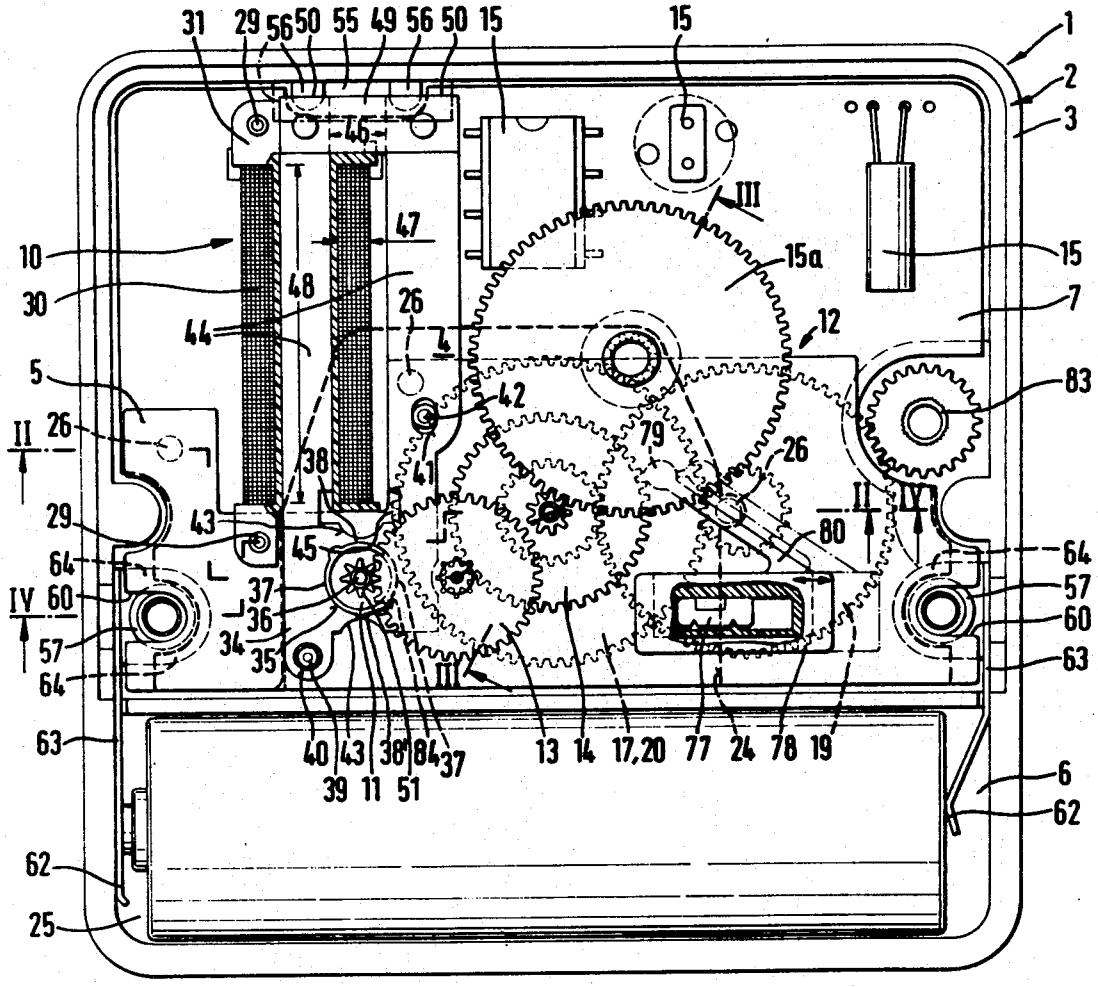
FIG. 1 is a rear elevational view of a clock movement according to the invention with the rear housing shell removed.

The clock movement 1 shown in the drawing has a housing formed of two cup-shaped shells, of which in FIG. 1 only the front shell 2 (equipped with the components of the movement ready for operation) is depicted in the direction of the surface 3 which forms a part of the interface between the shells.

A drive assembly 4 is set into the front shell 2. It comprises essentially a support plate 5, behind which is mounted a circuit board 7 disposed parallel to a front wall 6 of the housing and facing the latter. The support plate 5 is located approximately in the plane of the interface between the housing shells 8 (FIG. 2) and carries an elongated step motor stator 10 which protrudes past the periphery of the support plate 5. The plate 5 also carries a step motor rotor 11, together with a complete movement gearing 12 comprising an intermediate wheel 13 driven by the rotor 11, a second wheel driven by the wheel 13, and a third wheel 15*a*, driven by the second wheel.

On a side of the circuit board 7 facing toward the rear shell 9 are mounted electronic structural elements 15 for the electronic drive actuation circuit for the time proportional drive of the gears 12. These elements 15 include, in particular, an integrated circuit and a vibration stabilizing quartz oscillator and possibly an adjusting means for the setting of the timekeeping oscillating frequency.

Figure 2:
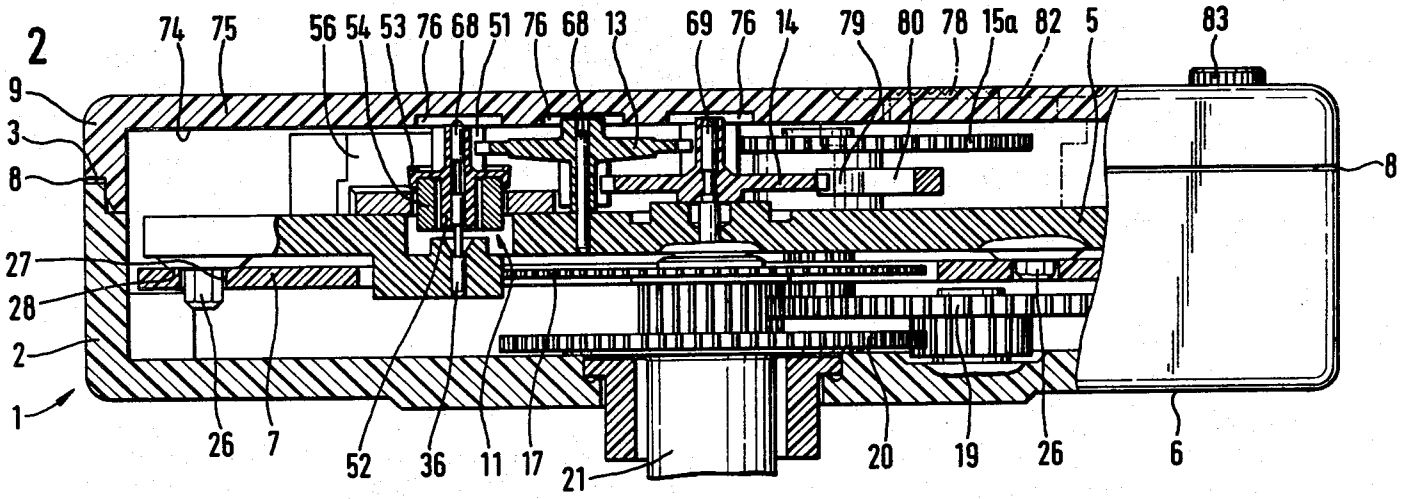
FIG. 2 is a sectional view taken along line II—II in FIG. 1.
Figure 3:
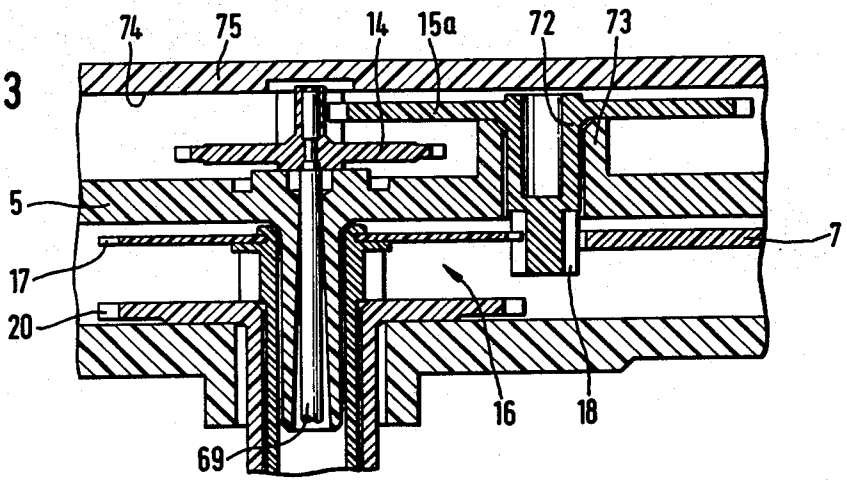
FIG. 3 is a partial sectional view taken along line III—III in FIG. 1.
Figure 4:
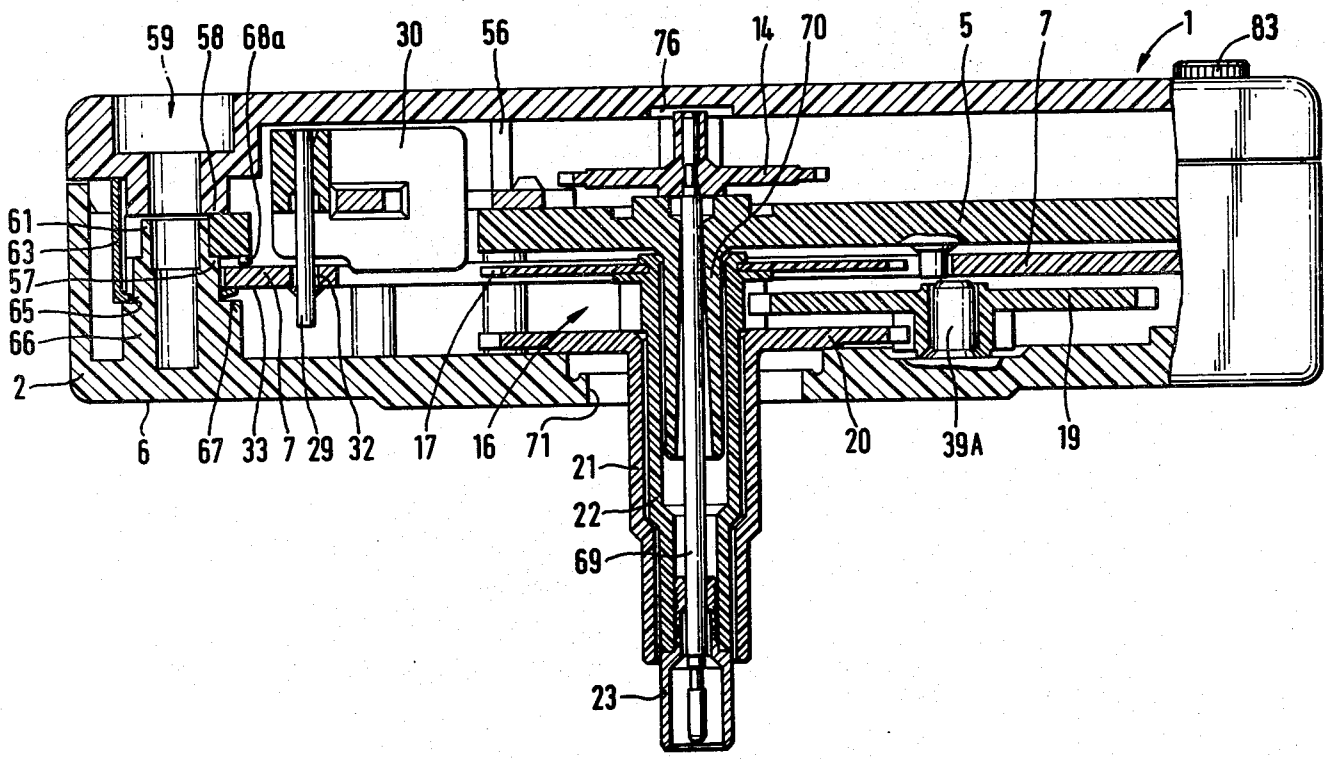
FIG. 4 is a sectional view taken along line IV—IV in FIG. 1, with the rear housing shell in place.

A hands movement 16 is mounted in front of the support plate 5 toward the inside of the front wall 6 of the housing (FIGS. 2, 3 and 4). The hands movement 16 comprises a minute wheel 17, driven by a pinion 18 of the third wheel 15*a* which protrudes through the support plate 5. The minute wheel drives a change wheel 19, which drives the hour wheel 20. This arrangement is well known per se as a drive train for a clock movement. The hour wheel 20 is, for example, provided integrally with an hour bushing 21 in the form of a shaft to carry the hour hand, while a minute bushing 22 is molded to the minute wheel 17 with the formation of a friction clutch, preferably carrying at its free end a profile insert 23 for the fastening of the minute hand (FIG. 4).

The circuit board 7 is flat and essentially rectangular, but with a broad peripheral recess 24 (FIG. 1) facing toward the battery chamber 25, whereby the circuit board 7 is U-shaped and overlies an area behind the support plate 5. The gears 12 and the rotor 11 of the step motor (serving as an electromechanical transducer for the drive of the gears 12) are bearingly supported on the circuit board 7. The circuit board 7 is held frictionally on the side of the support plate 5 facing the frontal wall 6 of the housing, by means of clamping studs 26 molded onto the support plate 5. The circuit board 7 has locating bores 27 (FIG. 2) which are pressured upon the studs 26 and into contact with a stop 28 formed on the clamping studs 26 (FIG. 2). A firm connection is further provided by pins 29 (FIG. 4) which also serve as electrical terminal pins of the coil for the ends of the windings on the stator coil 30 of the step motor. The pins 29 are injection molded with the synthetic plastic coil bobbin 31 and protrude through the circuit board bores 32, as do the elements 15, to be soldered to the laminated conductor strips (FIG. 1 and 4).

The stator coil 30 is held by the stator sheet 34, without the coil or its bobbin 31 resting on the circuit board 7. In this manner it is assured that dimensional tolerances of the circuit board 7 itself or mounting tolerances during the pressing of the board onto the clamping studs 26 have no effect on the dimensional accuracy between the rotor opening 35 and the rotor bearing 36, the latter being held by the support plate 5 (FIG. 2). The rotor opening 35 is defined by bays 84 of the stator sheet 34 which bays also determine the direction of rotation. The rotor opening 35 (FIG. 1) is of a simple circular geometry. Consequently, in spite of a mechanized mass production, a uniform and reproducible torque of the step motor is assured as the result of the stationary distance between the rotor bearing 36 and the rotor opening 35. The bays 84 are formed in pole shoes 37. The pole shoes 37 define the rotor opening 35 and are connected with each other in a dimensionally stable manner by means of thin pole shoe bridges 38 which are magnetically rapidly saturated. A locating bolt 39 (FIG. 1) is molded onto the support plate 5 in axially parallel relationship to the rotor bearing, and telescopingly engages a hollow locating lug 40 disposed on the stator sheet 34 adjacent to the rotor opening 35. The area of the stator sheet upon which the lug 40 is disposed rests flat on the support plate 5. Further locating of the stator sheet 34 on the support plate 5 is provided by an elongate slot 41 (FIG. 1) in a part of the stator 10 which is diametrically opposed to the locating lug 40. This slot 41 is engaged by a locating bolt 42 of the plate 5.

The two pole shoe bridges 38 contain bays 43 in the form of circular arcs facing away from the rotor opening 35. By means of the bridges 38, the two elongated legs 44 of the single layer stator sheet 34 are, at the time of stamping-out of the part, integrally connected with each other (they are stamped from sheet metal). The innermost of the two bays 43, i.e., facing toward the bobbin 30, communicates with a rectangular recess 45, which reduces the width of the leg and enlarges the intermediate space 46 defined between the legs. Thus, a short-circuiting of the magnetic field lines from the adjacent front end of the stator coil 30m (i.e., without passing through the pole shoes 37 and through the rotor opening 35) is effectively prevented. The radius of the coil bobbin 31 and thus of the winding of the stator coil 30 is approximately of the same size as the width of the intermediate space 46 of the stator legs. The winding layer 47 of the stator coil 30 on the long coil bobbin 31 is small in relation to the coil length 48, thereby yielding a good electromagnetic efficiency as the result of the small distance between the individual coil windings and the coil core (i.e., the projecting U-legs). This assures a favorable overall degree of efficiency of the step motor.

The magnetic back-circuit for the magnetic field lines passing through the stator sheet 34 is provided by a yoke sheet 49. The latter also provides mechanical stability for the dimensional accuracy of the stator 10 in the area of the rotor opening 35. The yoke sheet 49 is mounted to the legs, for example by means of a laser welded joint, and is seated upon the width surfaces of the rear ends 50 of the legs.

The permanent rotor 11 of the step motor comprises a thick walled hollow cylinder. Preferably, in a deviation from the conventional method of fabricating the rotor, the latter is not formed by the injection molding of a synthetic plastic hub with a pinion in the hollow cylindrical permanent rotor magnet, as this has heretofore resulted in a substantial mechanical radial stress on the hollow cylinder during the injection and the cooling of the synthetic material. Instead, the rotor 11 comprises a synthetic plastic pinion with a hub 52 molded on a shell or plate-like mounting 53 molded coaxially with it in the manner of a protruding collar flange with a circumferential mounting wall on its rim. A hollow cylindrical permanent magnet 54 has its front surface coaxially fastened in the mounting 53, for example by adhesive bonding or preferably by a friction-fit as seen in FIG. 2.

The positioning of the step motor in the clock movement 1 is effected on the one hand by means of the support plate 5 and on the other between the two housing shells 2, 9 approximately in or parallel to the plane of the housing interface 8. The rear ends 50 of the legs (which ends extend beyond the edge of the support plate 5 as seen in FIG. 1) are retained between a support projection 55 on the adjacent inner wall of the front housing shell 2 and supporting projections 56 (broken lines in FIG. 1) on the corresponding inner wall of the rear housing shell 9, when those shells are mated. The support plate 5, which is fastened to the front area of the stator sheet legs 44 as noted earlier, is clamped between pairs of supporting shoulders 47 (FIG. 4) and contact shoulders 58 of the shells 2, 9, respectively. The shoulders 57, 58 are clamped together by means of anchoring bolts 59, which thus secure the rear housing shell 9 to the front shell 2. For a stress free installation of the support plate 5, with the step motor fastened thereto, slots 60 (FIG. 1) are formed into the periphery of the support plate 5, which slots encompass a collar 61 (FIG. 4) protruding perpendicularly from the supporting shoulders 57 in the shape of a U. Thus, during the assembly of the shells 2, 9, the shoulders 57, 58 are aligned for a simple reception of the bolts 59 provided with self-tapping threads.

In the course of clamping the carrier plate 5 and its step motor between the shells 2, 9, there is simultaneously effected an electromechanical contacting of the lamination on the underside of the circuit board 7 with battery contact springs 62. The latter extend into the battery chamber 25, which is located in the front shell 2 adjacent to the support plate 5. The contact springs 62 are formed integrally as a part of a contact bridge 63 and a contact area 64. That is, the springs 62 each comprise one end of a contact bridge 63, arranged along a lateral wall of the front housing shell 2 and projecting into the chamber 25. The opposing end of each contact bridge 63 is angled off and extends at an angle to the contact bridge, with the latter being equipped with a positioning lug 65 (FIG. 4) placed upon a post 66 molded in the front wall 6 of the front housing shell 2. The post 66 extends parallel to the works axis. Provided on the post 66 are the collar 61 for the positioning of the support plate 5, and a further supporting shoulder 67 upon which the positioning lug 65 of the contact bridge 63 is resting. The annular peripheral area of the positioning lug 65 is curved upwardly, in order to form a spring elastic contact area 64 (FIG. 1) for engaging the lamination on the underside of the circuit board 7. That lamination is urged against the contact area 64 by means of a supporting projection **68*a* (FIG. 4) molded on an underside of the support plate 5 in order to establish the electric connection from the associated battery pole to the conductor strips in the circuit board. Thus, during the installation of the support plate 5 between the housing shells 2, 9** electrical connection is established with the circuit board lamination.

Assemblage of the clock movement 1 is effected by (i) the insertion of the hands movement 16 into the frontwardly open front housing shell 2, (ii) the installation of the pre-assembled drive assembly 4 between the shells 2, 9, and (iii) the insertion of the gear movement in the previously installed drive assembly 4. These insertions are all effected in the same direction. The front shell 2 performs a supporting function for the change wheel 19 of the gear movement in that the wheel 19 is placed upon a stud 39A (FIG. 4), molded onto the inside of the front wall 6. All other bearing supports of the gear movement 12 and the hands movement 16 are provided directly (or indirectly with respect to the hour wheel 20) on the support plate 5 itself. The supporting of the change wheel 19 by the shell 2 is the only supporting of the hands movement, drive assembly and gear movement which is performed by the shells. Actually, the change wheel merely interconnects other slowly revolving wheels that are not critical from a gearing standpoint. Thus, even though the shells 2, 9 serve as the carrier of a heavy clock face shield and thereby are mechanically stressed, the accurate gearing engagement of the step motor rotor pinion 51 through the gear wheels is always achieved. Therefore, a safe operation without varying conditions in view of the torque applied or the generation of noise, is assured.

The drive assembly 4, which may be pre-assembled to operational readiness independently from the completion of the clock movement 1, is equipped exclusively with flying bearings for the gear wheels. For this purpose, pins 68 (FIG. 2) are molded into the surface of the support plate 5 facing the rear housing shell 9 to form shaft ends for the rotor 11 and the gear movement 12. That surface of the plate 5 is appropriately provided with sockets and recesses, with the rotor hub 52 and the intermediate wheel 13 being placed on those pins in an axially displaceable manner. The second wheel 14, which is injection molded onto a second-hand shaft 69, is held by that shaft 69, which in turn is guided in an elongated hollow cylindrical shoulder 70 (FIG. 4) in the radial direction. That shoulder 70 is molded onto the side of the plate 5 facing the front wall 6 of the housing and extends into a passage orifice 71 for the hand shafts, in the front wall 6. The shoulder 70 has an internal bore expanding conically in the direction of the front wall 6 of the housing, with the radial support of the second hand shaft 69 being provided in the area of the support plate 5, where the internal diameter is approximately constant in the form of the circumference of a cylinder. The third wheel **15*a* has its drive pinion 18 engaging the hands movement on the opposite side of the support plate 5 at the end of a shaft end 72. The third wheel 15 is supported radially in a bore of a sleeve 73 which is located on the support plate 5 and which penetrates the support plate with its bore. The axial support of the rotor 11 and the hands movement 16 on the side of the shell 9 facing the support plate 5 is effected by the inner wall 74 of the rear wall 75. Opposite the axles of the rapidly revolving parts of the gears, i.e., opposite the pins 68 of the rotor 11 and the intermediate wheel 13 and opposite the rear end of the second hand shaft 69, are provided flat, cylindrical blind holes 76 in the rear wall 75. Those holes 76 serve as oil collectors and prevent the migration of gear oil from the rapidly revolving gear parts along the rear inner wall 74**.

The cylindrical outer circumference of the elongated hollow cylindrical shoulder 70 extending beyond the front side of the support plate 5 serves as the radial bearing for the minute bushing 22 in an area axially offset with respect to the bearing of the second hand shaft 69. The minute bushing carries, as a radial bearing, the hour bushing 21. Both bushings extend through the passage orifice 71 in the front wall 6. The front end of the second hand shaft 69 is further supported radially in the shoulder 23 of the minute bushing, in a manner well known. The axial immobilization of the hands movement 16 is effected between the inner side of the front wall 6 and the adjacent surface of the support plate 5, while the components thereof axially support each other.

As shown in FIG. 1, a snap-in holder 77 is provided on the support plate 5, preferably molded in the shape of a profiled rib. This holder 77 serves to hold and guide a lock bolt 78 having a sliding handle which projects through a guide slot 82 in the rear wall 75. An arm 80 ending in a locking claw 79 is molded onto the bolt 78 (FIG. 2). FIG. 1 depicts one of two locking positions for the locking claw 79 wherein the latter engages the gear beeth of the second wheel 14. Thus, the movement of the gear and hands movements is prevented, in spite of the continuing actuation of the step motor by means of actuating pulses. By sliding the bolt 78 into its other position, this engagement and thus the mechanical arrest of the movement is released, in order to restart the motion of the hands, for example following the manual rotation of an adjusting shaft 83, when a predetermined point in time has been attained.

Figure 5:
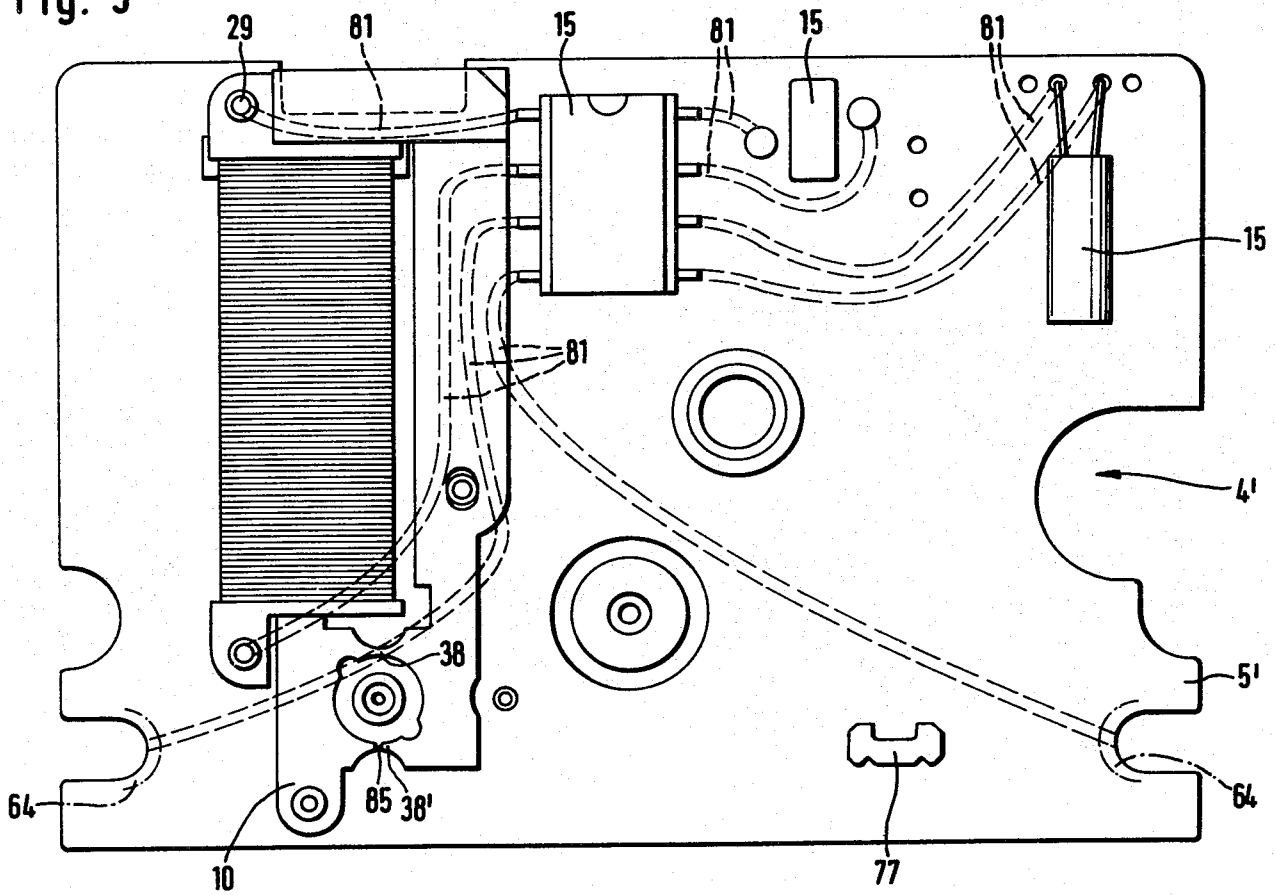
FIG. 5 is a view of the drive assembly equipped here only with the motor stator and electric structural elements, but in contrast to the view of FIG. 1, with printed or molded in conductor strips for a circuit board molded onto the circuit board.

A modification of the drive assembly is depicted in FIG. 5. This drive assembly 4' does not comprise an independently produced carrier plate 5 and a circuit board 7 held thereby. Rather, the support plate 5' extends essentially also over the area heretofore occupied by the circuit board 7 within the clock movement 1 (FIG. 1), with the synthetic plastic material of the support plate 5' being injection molded for example around a previously prepared conductor frame matrix 81, serving both to mechanically stiffen the support plate 5' and in particular to establish electric connections between the individual circuit elements 15. The latter are shown here in the same manner as in FIG. 1. It is also possible, however, to equip the support plate with depressed receptacles extending transversely to the plane of the circuit board, thereby making possible a denser packing of the higher structural elements in the area covered by the gear movement 12. It may be appropriate further to insert a module in place of the individual structural elements 15, wherein in particular, the oscillator quartz and the integrated circuit for the electronic drive actuating circuit, possibly with conductors to be separated for digital frequency equalization as a replacement for a trimmer capacitor, are combined both electrically and mechanically. The conductor frame matrix 81 is thereby reduced to a few conductor strips between the contact areas 64 (FIG. 1), the stator coil terminals 29 and such a module.

The drawings show that it is sufficient to close one of the two pole shoe bridges 38, while the other, preferably the pole shoe bridge 38' facing away from the coil, has a slot 85 aligned with the longitudinal axis of the stator. It has been found surprisingly that such a very narrow slot 85 may be applied (e.g., by stamping or sawing) even after the heat treatment of the stator sheet 34, and following the mechanical rigidizing of the stator frame by the attachment of the prestamped yoke sheet 49, without detrimentally affecting the efficiency of the stator, even while still employing the bays 43 opposite two closed pole shoe bridges 38. On the other hand, the application of such a small slot 85 yields the advantage of being able to effect a precision adjustment of the electromagnetic effects in the area of the pole shoes 37.

The present invention provides a clock movement highly efficient in operation, while being extraordinarily thin. A primary feature involves the externally premountable structural group comprising the support plate 5 (for the bearing support of the hands and gear movements and the step motor 10, 11), together with the circuit board 7 equipped with the electronic structural elements 15. This structural group is bordered and inserted in the housing shells of the movement 1 so that it can be mounted centrally between the shells 2, 9. Even in the case of the heavy screw mounting of weightly face carriers on the movement 1, there is no danger that this load on the front housing shell 2 will detrimentally affect the operation of the works, in particular the gear engagements and the positioning of the rotor at the stator. That is, such forces are absorbed by the housing shells themselves and are not transmitted to the operationally critical elements on the support plate 5. These functionally critical elements of the movement 1 are enclosed in a dust-proof manner by the two housing capsules 2, 9 so that interference by foreign bodies, such as dust particles, is excluded. The strong screw mounting by means of the anchoring bolts 59 between the two shells 2, 9 not only resists twisting of the clock housing but also creates a reliable, strong pressure of the battery contact springs 62 against the contact areas 64 of the circuit board.

Although the present invention has been described in connection with a preferred embodiment thereof, it will be appreciated by those skilled in the art that additions, deletions, modifications, and substitutions not specifically described, may be made without departing from the spirit and scope of the invention as defined in the appended claims.

What is claimed is:

1. A clock movement comprising:

front and rear housing shells, a support plate mounted within and between said shells, a gear movement mounted on a rear side of said support plate and facing said rear shell, a hands movement including a minute wheel and an hour wheel, said hands movement arranged on a front side of said support plate and being drivingly connected to said gear movement, a circuit board connected to said support plate and comprising an electronic drive actuating circuit, a motor comprising:

a stator sheet including means defining an opening for a rotor and being fastened in engaging relationship to a rear side of said support plate adjacent said opening-defining means, and a coil bobbin mounted on said stator sheet and including a plurality of pins, said pins defining coil terminals and being soldered to a circuit of said circuit board, a rotor disposed in said rotor opening and drivingly connected to said gear movement, said circuit board being disposed in front of said support plate in spaced relationship therewith and being of arc-like configuration such that legs of the arc straddle said minute and hour wheels.

2. A clock movement according to claim 1, including a rotor bearing mounted in a recess of said support plate and extending rearwardly therefrom, said rotor supported on said rotor bearing, a second pin mounted in said support plate, said gear movement including an intermediate wheel supported on said second pin, said rear wheel including a rear wall extending parallel to said support plate and including an oil collector hole aligned with said second pin, said intermediate wheel extending to said oil collector hole.

3. A clock movement according to claim 1, wherein said support plate includes a hollow cylindrical shoulder molded integrally therewith and projecting forwardly, said hour and minute wheels each including a bushing, said hour and minute bushings being telescoped together and mounted on said cylindrical shoulder, said shoulder including an inner bore which increases in diameter in a direction away from said support plate, a second hand shaft passing through said bore, a second wheel supported behind said support plate and connected to said second hand shaft.

4. A clock movement according to claim 1, wherein said front shell includes a front wall, a rearwardly extending bearing stud carried by said front wall, a change wheel mounted on said bearing stud, said change wheel being operably connected to said minute and hour wheels, and an adjusting shaft rotatably mounted in said rear shell and operably connected to said change wheel.

5. A clock movement according to claim 1, wherein said front and rear shells include mutually facing stop shoulders between which said support plate is clamped, and fastener means for forcing said shells together.

6. A clock movement according to claim 5, wherein one of said shells includes a plurality of posts through which said fastener means extends, each of said posts including a second supporting shoulder, said front shell including a battery chamber, a pair of battery contacts being provided, each battery contact including a spring portion extending into said battery chamber and a contact area mounted on said second supporting shoulder, said contact area being elastically arched and pressed against a circuit path of said circuit board by said first-named supporting shoulders of said shells.

7. A clock movement according to claim 1, wherein said stator sheet has a rear end positioned adjacent the peripheral interfacing edges of said front and rear shells, said shells including integrally molded shoulders engaging opposite sides of said rear end of said stator sheet to retain the latter against movement in a direction parallel to the axis of said hands movement.

8. A clock movement according to claim 1, wherein said stator sheet comprises two parallel legs which are longer in length than in width, said legs including interconnecting pole shoe means, the latter including two pole shoe bridges defining said rotor opening, said coil bobbin being mounted on one of said legs, the coil on said bobbin being longer in length than in diameter.

9. A clock movement according to claim 7, wherein said stator sheet includes a pair of legs having pole shoe means which comprise a pair of pole shoe bridges defining said rotor opening, said coil bobbin being mounted on one of said legs, said stator sheet further including a yoke sheet interconnecting rear ends of said legs.

10. A clock movement according to claim 9, wherein said rotor opening includes bays which define the rotational direction of said rotor, said pole shoe bridges each including a field guiding bay facing away from said rotor.

11. A clock movement according to claim 1, wherein said rotor comprises a rotor pinion drivingly connected to said gear movement, said rotor pinion having a hub, a dishshaped mounting molded onto said hub, and a hollow cylindrical permanent segment mounted on said dish-shaped mounting.

12. A clock movement according to claim 1, wherein said hands movement includes a second wheel, a lock bolt extending through a rear wall of said rear housing, said lock bolt including a locking claw arranged to enage said second wheel.

13. A clock movement according to claim 9, wherein one of said pole shoe bridges is slit along a longitudinal axis of said stator sheet.

* * * * *